United States Patent [19]

Sonobe

[11] Patent Number: 4,595,275

[45] Date of Patent: Jun. 17, 1986

[54] VARIABLE MAGNIFICATION COPYING APPARATUS

[75] Inventor: Hiraku Sonobe, Yokohama, Japan

[73] Assignee: Canon Kabushiki Kaisha, Tokyo, Japan

[21] Appl. No.: 586,067

[22] Filed: Mar. 5, 1984

[30] Foreign Application Priority Data

Mar. 8, 1983 [JP] Japan ..... 58-36577

[51] Int. Cl.[4] ..... G03G 15/30; G03G 15/00

[52] U.S. Cl. ..... 355/8; 355/14 SH; 355/14 C; 355/1

[58] Field of Search ..... 355/1, 8, 14 C, 14 R, 355/14 SH, 46

[56] References Cited

U.S. PATENT DOCUMENTS

| | | | |
|---|---|---|---|
| 4,126,389 | 11/1978 | Ikeda et al. | 355/13 |
| 4,331,380 | 5/1982 | Rees et al. | 355/1 X |
| 4,394,083 | 7/1983 | Rees | 355/1 |
| 4,405,207 | 9/1983 | Kay | 350/320 |
| 4,461,564 | 7/1984 | Ikenove | 355/14 C X |

*Primary Examiner*—Arthur F. Grimley
*Assistant Examiner*—C. Romano
*Attorney, Agent, or Firm*—Fitzpatrick, Cella, Harper & Scinto

[57] ABSTRACT

In $m_1$ magnification copy mode, a photosensitive member, at the first exposure station is exposed to the light image of an original existing at the first illumination position through a first lens array. In $m_2$ magnification copy mode, the photosensitive member, at the second exposure station, is exposed to the light image of the original existing at the second illumination position through a second lens array. The original is moved through the first and second illumination positions in sequence while the photosensitive member is moved through the first and second exposure stations in the order named. Registration rollers for feeding transfer materials to a transfer station is operated with different timings in the $m_1$ magnification and $m_2$ magnification modes, these timings being different from each other by a period of time which corresponds to the spacing between the first and second exposure stations.

6 Claims, 4 Drawing Figures

VARIABLE MAGNIFICATION COPYING APPARATUS

BACKGROUND OF THE INVENTION

1. Field of the Invention

The present invention relates to a variable magnification copying apparatus which utilizes a plurality of imaging element arrays.

2. Description of the Prior Art

There is known an imaging element array including a plurality of small diameter rod-like light guiding elements with its progressive reduction of refractive index in the radial direction thereof and with an imaging function, available from Nippon Sheet Glass Co., Ltd. as SELFOC (trade mark), these light guiding elements being arranged in one or more lines to form a composite image consisting of plural small image sections of an original. In recent years, an imaging element array for forming the image of an original at various magnifications other than real size has been proposed, for example, in Japanese Laid-open Patent Application No. 56-24308 or U.S. Pat. No. 4,405,207. Furthermore, a magnification changeable system wherein plural imaging element arrays are used has been proposed, for example, in U.S. Pat. Nos. 4,331,380 or 4,394,083.

If such a variable magnification copying system is of a structure in which the imaging element arrays having different magnifications are changed in position upon the change of magnification, a highly precise array moving mechanism will be required to always obtain a properly focused image at any magnification since each of these imaging element arrays normally has a relatively small focal depth in the order of 0.1 to 0.7 mm. It is thus preferred that the respective imaging element arrays remain stationary while at the same time a mechanism for changing the optical path, such as a shutter or the like, is used to prevent out-of-focus image. In such a case, however, a position at which the photosensitive member is to be exposed to the light image of the original varies in accordance with the selected magnification. When the magnification is changed, therefore, the positional relationship between the image of the original and the transfer material will be disturbed.

U.S. Pat. Nos. 3,865,482 and 4,126,389 disclose systems for changing the magnification while at the same time varying the timing with which transfer materials are fed out. However, these systems are adapted to change the magnification by moving a large-sized lens structure such that the exposure position of the photosensitive member to the image of an original is not changed in the direction in which the photosensitive member is moved. The just above mentioned U.S. patents do not suggest the conveying and controlling technique of transfer material which can be used in a variable magnification copying system which utilizes a plurality of imaging element arrays having different imaging magnifications and is of such a structure that the exposure position of the light original image through the imaging element array is changed in the direction of the photosensitive member's movement.

SUMMARY OF THE INVENTION

It is an object of the present invention to provide a variable magnification copying apparatus which utilizes a plurality of imaging element arrays having different imaging magnifications.

Another object of the present invention is to provide a variable magnification copying apparatus which utilizes a plurality of imaging element arrays having different imaging magnifications and which can form the image of an original on a transfer material in a predetermined positional relationship therebetween at any magnification of copy.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Figure 1:
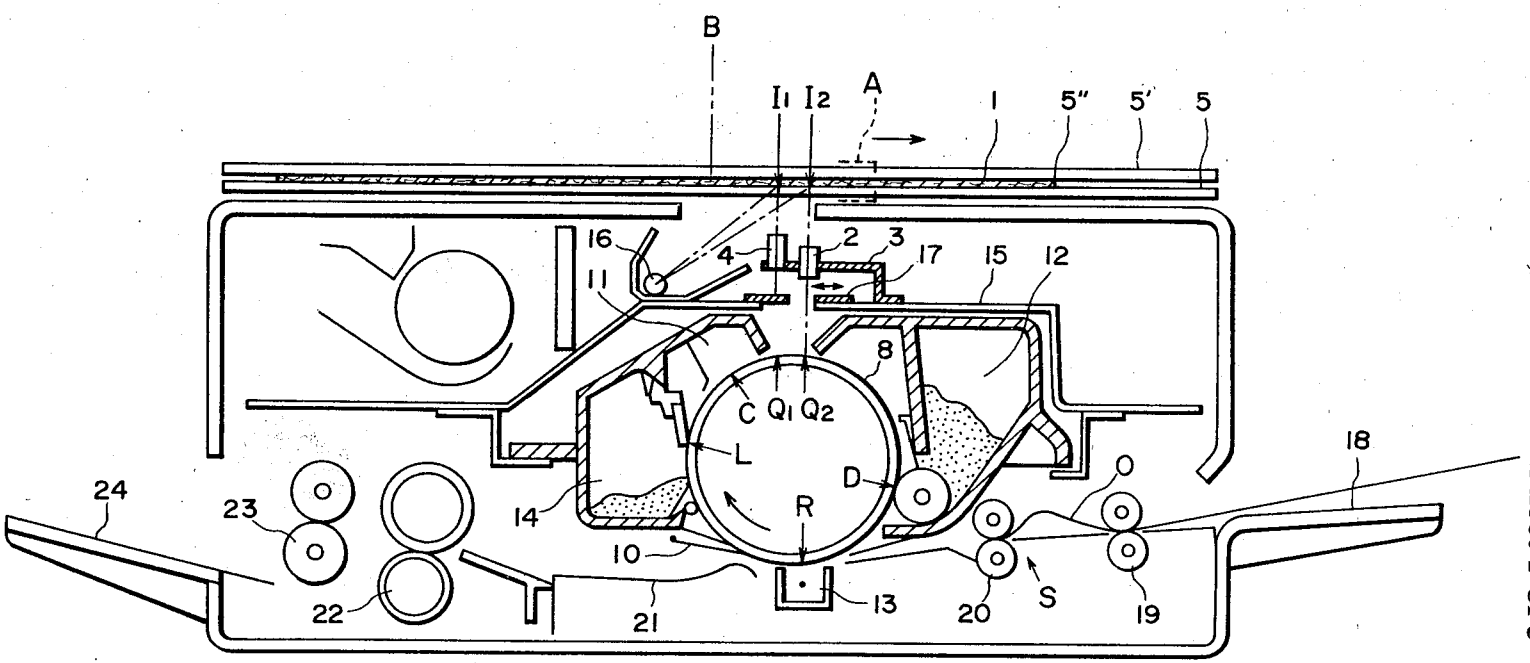
FIG. 1 is a cross-sectional view of an apparatus according to one embodiment of the present invention.
Figure 2:
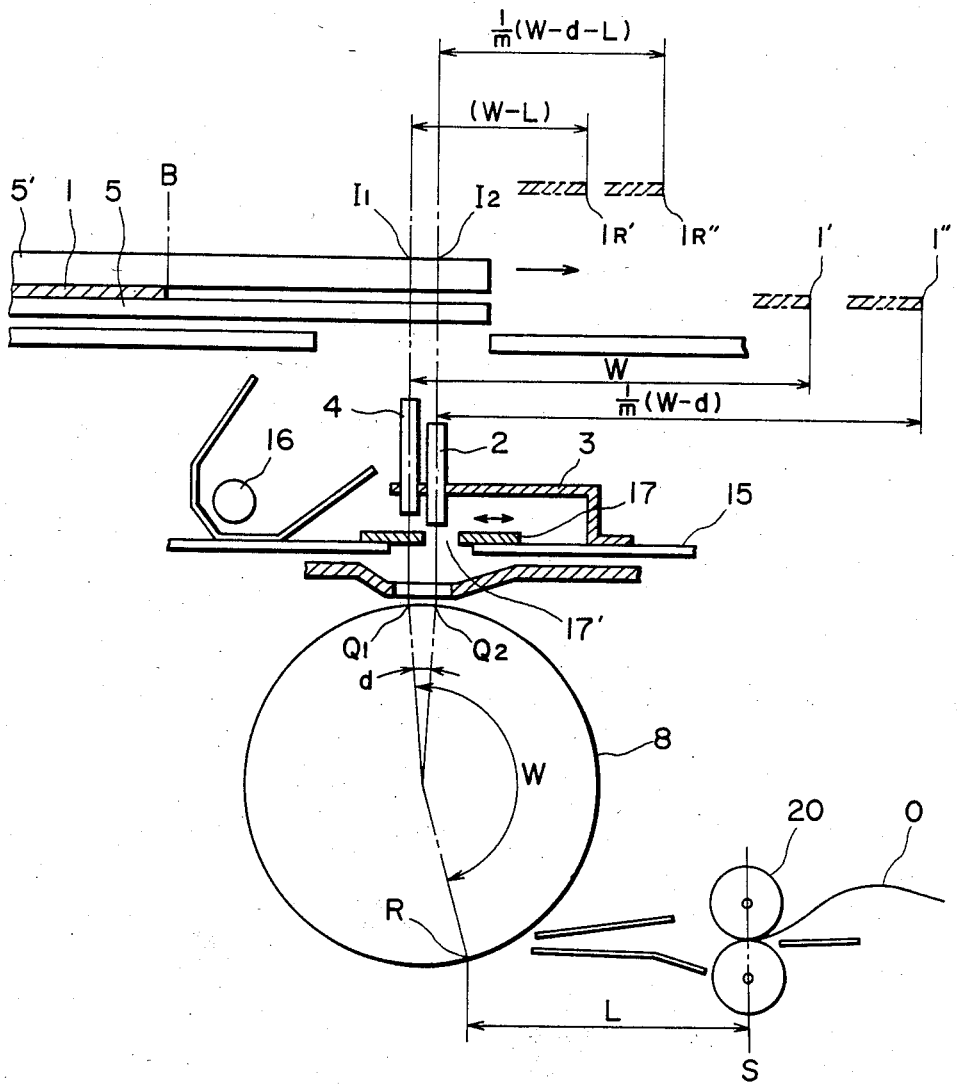
FIG. 2 is a diagrammatic view showing a portion of an apparatus the apparatus according to the embodiment of the present invention.

Referring to FIGS. 1 and 2, an electrophotographic type photosensitive drum 8 including an electrically conductive substrate and a photoconductive layer thereon is rotated clockwise at a constant peripheral speed $\alpha$ in any copy mode inclusive of one-to-one and m magnification ($m<1$). During rotation, the photosensitive drum 8 passes by a charging station C, a first exposure station $Q_1$, a second exposure station $Q_2$, a developing station D, a transfer station R and a cleaning station L in sequence.

The photosensitive drum 8 is uniformly charged by a charger 11 at the charging station C and then exposed to the light image of an original 1 at the exposure stations $Q_1$ or $Q_2$ to form an electrostatic latent image thereon. The electrostatic latent image is then developed with the toner by a developing device 12 at the developing station D to form a toner image. This toner image is then transferred onto a transfer material O by a transfer corona discharger 13 at the transfer station R. The transfer material O has manually been supplied into a transfer material supply tray 18 and then conveyed to the transfer station R through a pair of conveying rollers via a pair of registration rollers 20. The transfer material O is once stopped at a stand-by position S with the leading edge thereof being in the nip of the conveying rollers 20 and then fed to the transfer station R at the same speed as that of the photosensitive sensitive drum 8 when the conveying rollers 20 are re-driven. Upon completion of the transfer step, the transfer material is separated from the drum 8 by separation means 10 and then fed along a path of movement 21 into a fixing device 22 whereat the toner image is fixed to the transfer material. Thereafter, the transfer material is discharged into a tray 24 through discharge rollers 23.

The original to be copied 1 is placed on a movable carriage 5 and pressed against this carriage 5 by means of a holding cover 5'. At copy of any magnification, the leading edge of the original 1 is aligned with a reference position 5'' on the carriage 5. Upon initiation of the copy, the carriage 5 is once moved leftwardly from the position of FIG. 1 and stopped when the leading edge of the carriage 5 reaches a position A. At the same time, the leading edge of the original 1 reaches a position B.

The carriage 5 is then moved rightwardly to carry the original 1 through a first and second illumination positions $I_1$ and $I_2$ in order. At both the illumination positions $I_1$ and $I_2$, the original 1 is illuminated by a common illuminating lamp 16. The rightward movement of the carriage 5, that is, the scanning of the original 1 is accomplished at a speed equal to the speed of the photosensitive member 8 divided by the selected magnification. In any event, the rightward movement speed of the carriage 5 is made stable until the leading edge of the original 1 reaches the first illumination position $I_1$. When the photosensitive member 8 has been exposed to the light image of the original, that is, when the scanning of the original has been terminated, the carriage 5 is then moved leftwardly and returned to the position shown in FIG. 1.

In the one-to-one copy mode, during the rightward movement of the original 1, the photosensitive member 8 is exposed to the real-sized light image of the original existing in the first illumination position $I_1$ through a first imaging element array 4 at the first exposure station $Q_1$. In an m magnification copy mode, during the rightward movement of the original, the photosensitive member 8 is exposed to the m magnification image of the original existing in the second illumination position $I_2$ through a second image element array 2 at the second exposure station. The first and second imaging element arrays 4 and 2 are fixedly mounted on the machine frame 15 by a bracket 3 at the respective positions shown in FIG. 1.

The image element array 4 includes a plurality of small diameter imaging elements each having a real-sized image forming function and which are arranged parallel to one another in one or more lines. The image element array 2 includes a plurality of small diameter imaging elements each having an m magnification image forming function and which are arranged in one or more lines in a fan fashion. Such arrays 2 and 4 may be those described in U.S. Pat. No. 4,331,380, for example.

The machine frame 15 supports a movable slit plate 17 having a slit-like opening 17' formed therein (FIG. 2). In one-to-one copy mode, the slit plate 17 is so positioned that its opening 17' is within the optical path between the first array 4 and the first exposure station $Q_1$ while blocking the optical path between the second array 2 and the second exposure station $Q_2$. In the m magnification copy mode, the position of the slit plate 17 is so changed that its opening 17' is between the second array 2 and the second exposure station $Q_2$ while blocking the optical path between the first array 4 and the first exposure station $Q_1$. Although the optical path between the arrays 2 and 4 and the photosensitive member 8 is selectively closed by the slit plate 17 in the illustrated embodiment, the optical path between the carriage 5 and the arrays 2 and 4, not between the arrays 2 and 4 and the exposure stations, may selectively be closed by any suitable means.

Figure 3A:
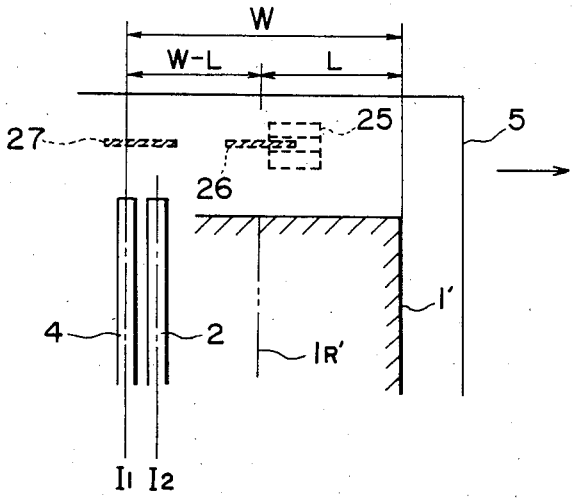
FIGS. 3A and 3B are diagrammatic views showing a portion of an apparatus according to still another embodiment of the present invention.
Figure 3B:
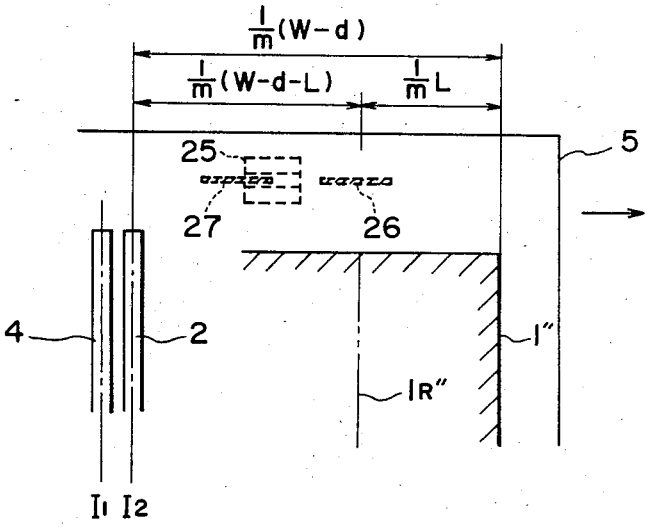

There will now be described the control of the registration rollers 20 for aligning the leading edge of a transfer material with the leading edge of the original image (toner image) for all copy modes. FIGS. 3A and 3B show a signal generator 25 fixedly mounted on the machine frame and including a light-emission element and photoconductive element arranged opposed thereto, and light blocking plates 26 and 27 fixedly mounted on the carriage 5 and adapted to move between the light-emission and photoconductive elements in the signal generator 25 when the carriage 5 is moved as described hereinbefore. If the plate 26 or 27 is positioned between the light-emission and photoconductive elements to block the optical path therebetween, the photoconductive element generates a signal. In one-to-one copy mode, the registration rollers 20 are actuated by a signal generated at the signal generator 25 when the plate 26 is positioned between the light-emission and photoconductive elements. On the other hand, in the m magnification copy mode the signal generator 25 generates a signal when the plate 27 is positioned between the light-emission and photoconductive elements. Similarly, this signal actuates the registration rollers 20.

Operational timings of the registration rollers 20 in both the one-to-one and m×magnification copy modes will be described below.

Now suppose that a distance on movement of the photosensitive member from the first exposure station $Q_1$ to the transfer station R is W (FIG. 2); a distance on movement of the photosensitive member between the first and second exposure stations $Q_1$ and $Q_2$ is d; a distance on movement of the transfer material from the registration rollers 20 by which the leading edge of the transfer material is engaged and stopped by the registration rollers 20 at the stand-by-state to the transfer station R is L; and the speed of the photosensitive member is $\alpha$. In the one-to-one copy mode, the original is moved rightwardly at the speed $\alpha$. In the m magnification copy mode, the original is moved rightwardly at a speed of $\alpha/m$.

In the one-to-one copy mode, in a period of time from a point of time when the leading edge of the original 1 reaches the first illumination position $I_1$ and the photosensitive member 8 begins to be exposed to the one-to-one image of the original 1 at the first exposure station $Q_1$ to a point of time when the leading edge of the image formed on the photosensitive member 8 reaches the transfer station R, the leading edge of the original 1 moves to a position 1' spaced away from the first illumination position $I_1$ rightwardly by the distance W. In the illustrated embodiment, therefore, the light blocking plate 26 for one-to-one copy mode enters between the light-emission and photoconductive elements of the signal generator 25 when the leading edge of the original reaches a position spaced away from the position 1' leftwardly by the distance L, that is, a position $1'_R$ spaced away from the first illumination position $I_1$ rightwardly by a distance (W—L). At this time, the signal generator 25 produces a signal which actuates the registration rollers 20 to initiate the movement of the transfer material O from the stand-by position S to the transfer station R.

In the m magnification copy mode, in a period of time from a point of time when the leading edge of the original 1 reaches the second illumination position $I_2$ and the photosensitive member 8 begins to be exposed to the m×magnification image of the original 1 at the second exposure station $Q_2$ to a point of time when the leading edge of the original image formed on the photosensitive member 8 reaches the transfer station R, the leading edge of the original 1 moves to a position 1'' spaced away from the second illumination position $I_2$ rightwardly by a distance $(W-d)/m$. In the illustrated embodiment, therefore, the light blocking plate 27 for m magnification copy mode enters between the elements in the signal generator 25 when the leading edge of the original reaches a position spaced away from the position 1'' leftwardly by a distance L/m, that is, a position $1''_R$ spaced away from the second illumination position rightwardly by a distance (W−d−L)/m. At this time, the signal generator 25 produces a signal which actuates the registration rollers 20 to initiate the movement of the transfer material O from the stand-by position S to the transfer station R.

The present invention is not limited to the one-to-one and m magnification copy modes and may be applied to such a system that can be operated in a plurality of other magnification copy modes. For example, in such a copying system that can be operated in $m_1$ and $m_2$ magnification copy modes, the registration rollers 20 will be actuated in the following manner:

In the $m_1$ magnification copy mode, the signal generator 25 produces a signal when the leading edge of the original reaches a position spaced away from the first illumination position $I_1$ rightwardly by a distance $(W-L)/m_1$. This signal actuates the registration rollers 20. In the $m_2$ magnification copy mode, when the leading edge of the original reaches a position spaced away from the second illumination position $I_2$ rightwardly by a distance $(W-d-L)/m_2$, the signal generator 25 produces a signal which actuates the registration rollers 20. Thus, in the one-to-one or $m_1$ magnification copy mode, the registration rollers 20 are actuated after a period of time $(W-L)/\alpha$ when the photosensitive member 8 begins to be exposed to the light image of the original at the first exposure station $Q_1$. In the m or $m_2$ magnification copy mode, the registration rollers 20 are actuated after a period of time $(W-d-L)/\alpha$ when the photosensitive member 8 begins to be exposed to the light image of the original at the second exposure station $Q_2$. Thus, the leading edge of the original image can properly be aligned with the leading edge of the transfer material in any copy mode although the exposure stations $Q_1$ and $Q_2$ are spaced away from each other in the direction in which the photosensitive member is moved. The time period $(W-d-L)/60$ is smaller than the time period $(W-L)/\alpha$ by a period of time $d/\alpha$ which is the one required for the photosensitive member 8 to move between the first and second exposure stations $Q_1$ and $Q_2$.

The signal generator may be any other suitable device such as a microswitch, Hall element or the like.

Although the aforementioned embodiment has been described as to two actuators 26 and 27 mounted on the carriage 5, a single actuator may be mounted on the carriage 5 and a plurality of signal generators may be mounted on the machine frame at positions corresponding to the respective magnifications to be selected. Alternatively, a single actuator may be mounted on the carriage 5 and a single signal generator may be mounted on the machine frame. In this case, a signal from the single signal generator may be applied to a timer through which the registration rollers 20 is to be actuated. Time period to be set in the timer is changed depending on the selected magnification such that said timings upon actuating the registration rollers is realized.

If the first and second arrays are disposed parallel to each other, the spacing between the first and second illumination positions $I_1$ and $I_2$ will be equal to that between the first and second exposure stations $Q_1$ and $Q_2$. If the first and second arrays are arranged not parallel to each other, however, the above spacings are different from each other.

In accordance with the present invention, three or more imaging element arrays having different imaging magnifications may be used to select any one of three or more copy magnifications.

The photosensitive member may be of a belt type rather than the drum type. Each of the imaging element arrays may be constituted by a plurality of small diameter spherical of aspherical lenses arranged in one or more lines.

Furthermore, the present invention may be applied to a copying system of such a type that an electrostatic latent image is formed on a photosensitive member and then transferred to a transfer material on which the latent image is then developed.

While the invention has been described with reference to the structures disclosed herein, it is not confined to the details set forth and this application is intended to cover such modifications or changes as may come within the purpose of the improvements or the scope of the following claims.

What is claimed is:

1. A variable magnification copying apparatus comprising:

an electrophotographic type photosensitive member movable by a first exposure station, a second exposure station and a transfer station in sequence;

means for moving an original to be copied through a first illumination position and a second illumination position in the order named;

a first imaging element array for forming a light image of the original moving through said first illumination position on said photosensitive member at $m_1$ magnification at said first exposure station in $m_1$ magnification copy mode;

a second imaging element array for forming a light image of the original moving through said second illumination position on said photosensitive member at $m_2$ magnification at said second exposure station in $m_2$ magnification copy mode;

registration means for holding a transfer material at a stand-by position when it is not actuated and for moving the transfer material out of the stand-by position toward said transfer station when it is actuated; and control means for actuating said registration means, said control means actuating said registration means a first predetermined time after said photosensitive member begins to be exposed to the light image of the original at said first exposure station in the $m_1$ magnification copy mode, and actuating said registration means, a second predetermined time after said photosensitive member begins to be exposed to the light image of the original at said second exposure station in the $m_2$ magnification copy mode, said second predetermined time being different from said first predetermined time by a period corresponding to the distance between said first and second exposure stations.

2. A variable magnification copying apparatus as defined in claim 1 wherein said second predetermined time is smaller than said first predetermined time by a period required for said photosensitive member to move from said first exposure station to said second exposure station.

3. A variable magnification copying apparatus as defined in claim 1 wherein said control means actuates said registration means when the leading edge of said original reaches a position spaced away from said first illumination position by a distance of $(W-L)/m_1$ in the $m_1\times$ magnification copy mode and actuates said registration means when the leading edge of said original reaches a position spaced away from said second illumination position by a distance of $(W-d-L)/m_2$ in the $m_2\times$magnification copy mode, where W is a distance measured along a periphery of said photosensitive member from said first exposure station to said transfer station, d is a distance measured along the periphery of said photosensitive member from said first exposure station to said second exposure station, and L is a distance through which the transfer material moves from the stand-by position to said transfer station.

4. A variable magnification copying apparatus as defined in claim 2 wherein said control means actuates said registration means when the leading edge of said original reaches a position spaced away from said first illimination position by a distance of $(W-L)/m_1$ in the $m_1\times$magnification copy mode and actuates said registration means when the leading edge of said original reaches a position spaced away from said second illumination position by a distance of $(W-d-L)/m_2$ in the $m_2\times$magnification copy mode, where W is a distance measured along a periphery of said photosensitive member from said first exposure station to said transfer station, d is a distance measured along the periphery of said photosensitive member from said first exposure station to said second exposure station, and L is a distance through which the transfer material moves from the stand-by position to said transfer station.

5. A variable magnification copying apparatus comprising:

an electrophotographic type photosensitive member movable by a first exposure station, a second exposure station and a transfer station in sequence;

means for moving an original to be copied at a speed corresponding to a selected magnification;

a first imaging element array for forming a light image of the original on said photosensitive member at $m_1$ magnification at said first exposure station in $m_1$ magnification copy mode;

a second imaging element array for forming a light image of the original on said photosensitive member at $m_2$ magnification at said second exposure station in $m_2$ magnification copy mode;

registration means for holding a transfer material at a stand-by positon when it is not actuated and for moving the transfer material out of the stand-by position toward said transfer station when it is actuated; and control means for actuating said registration means in timed relation with an instance when said photosensitive member begins to be exposed to the light image of the original, said timed relation being different depending upon whether $m_1$ magnification copy mode is selected or $m_2$ magnification copy mode is selected, wherein a period from the start of the exposure to actuation of registration means in the $m_1$ magnification copy mode is longer than the period in the $m_2$ magnification copy mode by a period corresponding to a distance between said first and second exposure stations.

6. A variable magnification copying apparatus according to claim 5, wherein said period corresponding to the distance between said first and second exposure stations is equal to a period required for said photosensitive member to move from said first exposure station to said second exposure station.

* * * * *

UNITED STATES PATENT AND TRADEMARK OFFICE

CERTIFICATE OF CORRECTION

PATENT NO. : 4,595,275

DATED : June 17, 1986

INVENTOR(S) : Hiraku Sonobe

It is certified that error appears in the above-identified patent and that said Letters Patent is hereby corrected as shown below:

Col. 5, line 39 "(W-d-L)/60" should read --(W-d-L)/$\alpha$ --.

Signed and Sealed this

Third Day of February, 1987

*Attest:*

DONALD J. QUIGG

*Attesting Officer*

*Commissioner of Patents and Trademarks*